United States Patent [19]

Funk

[11] 4,361,096

[45] Nov. 30, 1982

[54] RAILWAY HOPPER CAR DOOR SEAL

[75] Inventor: Stanley T. Funk, Cincinnati, Ohio

[73] Assignee: Ortner Freight Car Company, Milford, Ohio

[21] Appl. No.: 949,240

[22] Filed: Oct. 6, 1978

[51] Int. Cl.[3] ..... B61D 7/04; B61D 7/18; B61D 7/22

[52] U.S. Cl. ..... 105/248; 105/253; 105/282 A; 105/308 A; 105/424

[58] Field of Search ..... 105/248, 253, 282 A, 105/308 A, 424, 247

[56] References Cited

U.S. PATENT DOCUMENTS

| | | | |
|---|---|---|---|
| 743,504 | 11/1903 | Hart | 105/424 X |
| 761,550 | 5/1904 | Simonton | 105/424 X |
| 776,149 | 11/1904 | Simonton | 105/424 X |
| 987,877 | 3/1911 | Harrigan | 105/424 X |
| 1,014,768 | 1/1912 | Meissner | 105/424 X |
| 1,882,186 | 10/1932 | Hankins | 105/424 X |
| 2,602,402 | 7/1952 | Sanford, Jr. et al. | 105/424 X |
| 3,169,491 | 2/1965 | Darlington et al. | 105/424 X |
| 3,187,684 | 6/1965 | Ortner | 105/248 |
| 3,401,645 | 9/1968 | Floehr | 105/424 X |
| 3,596,608 | 8/1971 | Aquino et al. | 105/240 X |
| 3,596,609 | 8/1971 | Ortner | 105/253 X |
| 3,596,611 | 8/1971 | Floehr | 105/282 A |
| 3,807,318 | 4/1974 | Chierici | 105/282 A |

*Primary Examiner*—Joseph F. Peters, Jr.
*Assistant Examiner*—Howard Beltran
*Attorney, Agent, or Firm*—Frost & Jacobs

[57] ABSTRACT

Seals to prevent seepage of a fine granular commodity between the hopper doors and the adjacent hopper sheets of a railroad hopper car of the type having opposed pairs of hopper doors swingable between a closed position and a downwardly depending open position. The seals comprise elongated strips of flexible material with their upper longitudinal edge portions mounted along the inside lower edges of the inner and outer hopper sheets and being of a width such that their free lower longitudinal edge portions extend downwardly beyond the lower edges of the hopper sheets. The free edge portions of the seals being bent inwardly by and lying in sealing engagement against the hopper doors when the hopper doors are in their closed position. Similar strips of flexible material may be so located as to form a seal between the upper portion of each hopper door and its adjacent slope sheet.

25 Claims, 16 Drawing Figures

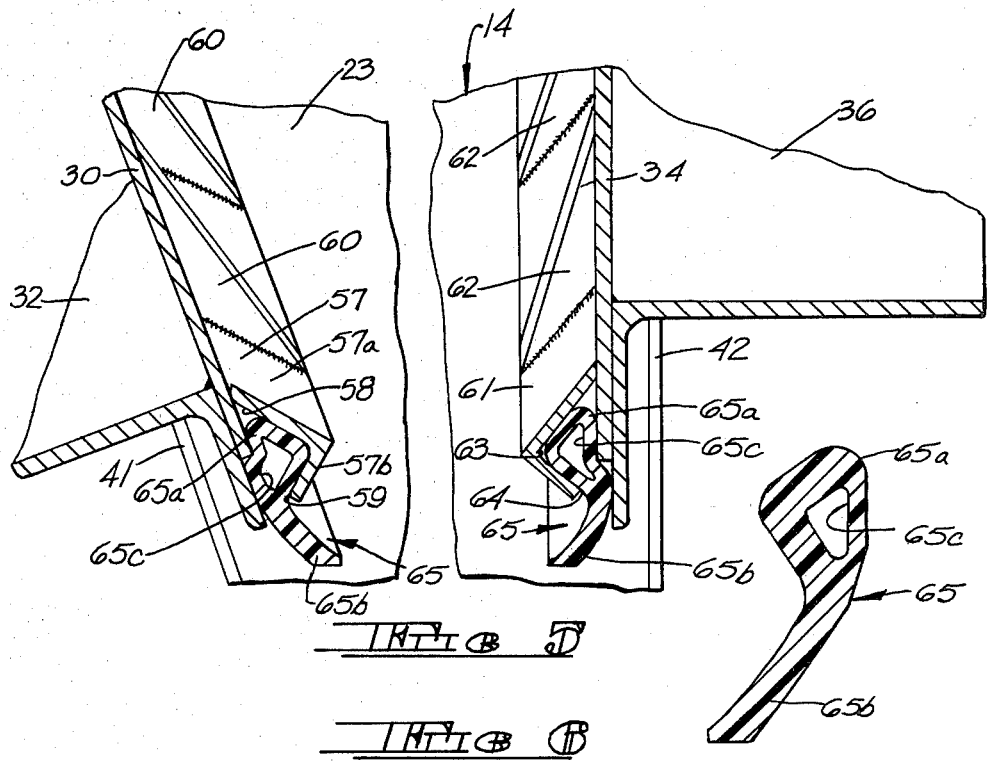
FIG. 5
FIG. 6
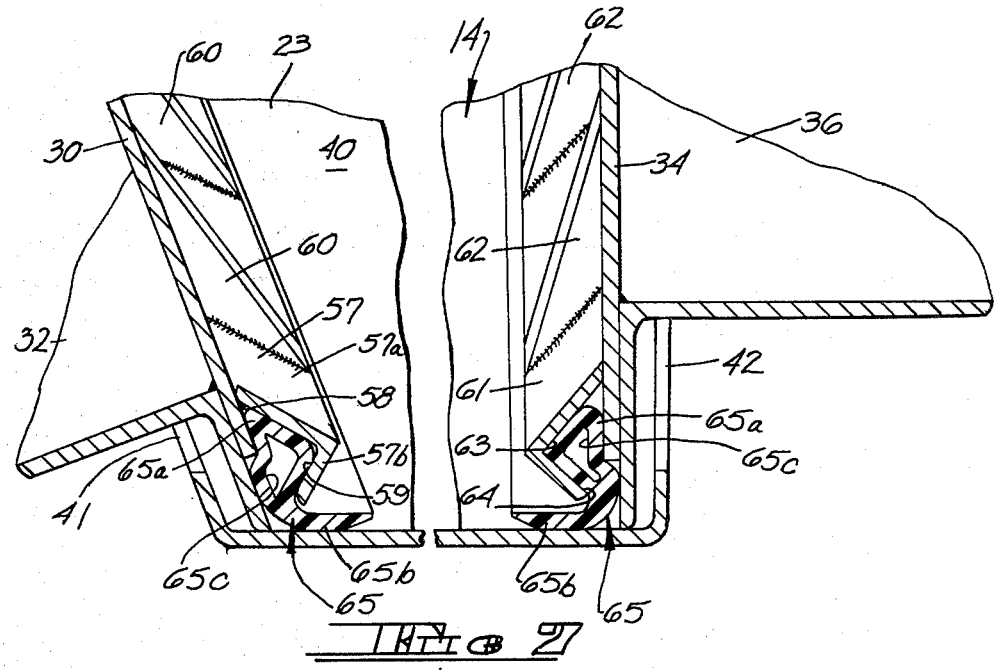
FIG. 7

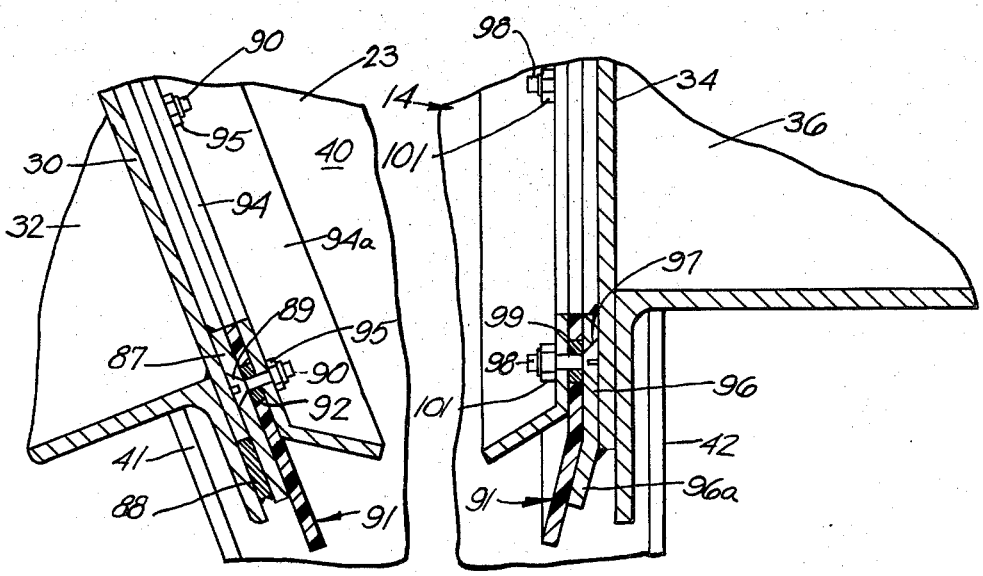
FIG. 13
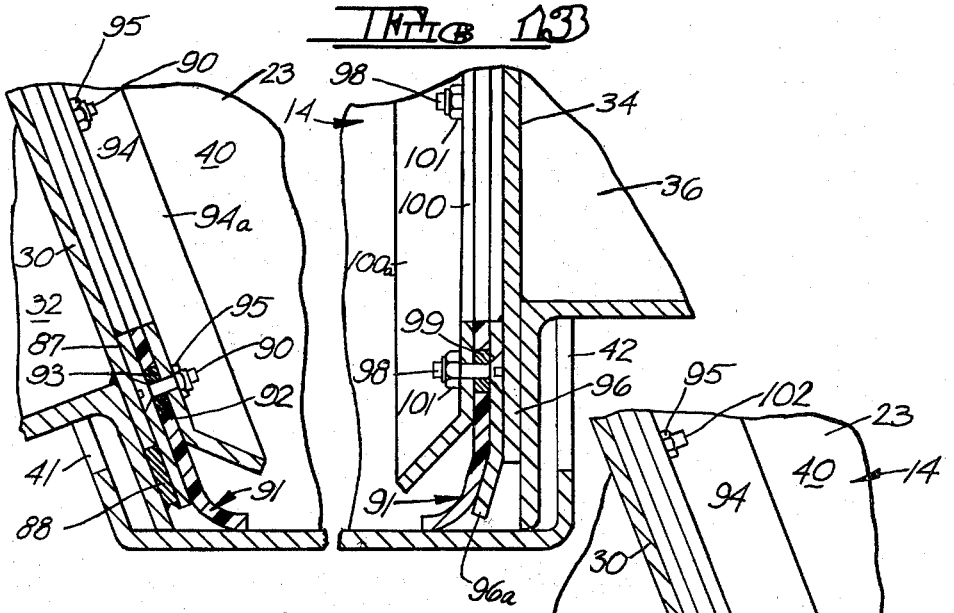
FIG. 14
FIG. 15

RAILWAY HOPPER CAR DOOR SEAL

TECHNICAL FIELD

The invention relates to seals for the hopper doors of a railroad hopper car, and more particularly to replaceable seals to prevent seepage of a fine, granular commodity between an opposed pair of hopper doors and the adjacent inner and outer hopper sheets and/or the adjacent slope sheets for that pair of doors.

BACKGROUND ART

While the seals of the present invention are not intended to be so limited, for purposes of an exemplary showing, they will be described in terms of their application to the relatively recently developed large hopper cars capable of carrying large loads and discharging their loads very quickly and efficiently. An exemplary car of the type contemplated is taught in U.S. Pat. No. 3,187,684 or U.S. Pat. No. 3,596,609. The bottom of such a car is made up of chutes which are partially intersected by the center sill of the car. Each chute comprises a pair of outer, substantially triangular hopper sheets depending downwardly and slightly inwardly of the car sides and a pair of substantially triangular inner hopper sheets located to either side of the car center sill. Each chute is provided with a pair of opposed hopper doors swingable between a closed position and a downwardly depending open position. Each hopper door is made up of two door panels joined together by appropriate transverse bracing and located to either side of the center sill. The panels of each door are appropriately hinged to transverse members of the car underframe. Opposed pairs of panels of an opposed pair of hopper doors cooperate with an inner and an outer hopper sheet located on the same side of the car center sill to close their respective chute.

The above mentioned U.S. Pat. No. 3,596,608 teaches various means whereby the bottom edges of the panels of an opposed pair of hopper doors form a seal therebetween to prevent leakage of a fine, granular commodity therebetween. Excellent results have been achieved, for example, when the opposed pair of hopper doors are so arranged that a first door of the pair closes slightly ahead of the second door of the pair. The bottom edges of the panels of the first door are configured to form a curved return flange which rests on the bottom edges of the panels of the second door when the hopper doors are in their closed position. As the hopper car is loaded, the hopper doors "seat" under the weight of the lading. The return flanges at the lower edges of the panels of the first door act as seals, bearing against and conforming to the contour of the bottom edges of the panels of the second door, thus providing a continuous metal-to-metal seal along these lines of contact between the panels of the opposed pair of hoppers doors. It has been found that no additional sealing is required at these interfaces between the panels of an opposed pair of hopper doors.

Hopper cars of the type contemplated are frequently used to haul fine, granular commodities such as wet rock, sand, aggregates, grain, or the like. It has been found that such fine, granular, fluid-type commodities can, under some circumstances, seep between the hopper door panels and the lower edges of the adjacent inner and outer hopper sheets. When the hopper doors are in their closed position, a metal-to-metal seal (like that formed between the lower edges of opposed hopper door panels) is not achieved between the hopper door panels and the adjacent inner and outer hopper sheets. This is particularly true when the opposed pairs of hopper doors "seat" under the weight of the lading.

The present invention is directed primarily to seals to prevent undesired seepage of a fine, granular commodity between the hopper door panels and the adjacent inner and outer hopper sheets, when the hopper doors are in closed position. To this end, elongated flexible sealing strips are removably and replaceably mounted along the inside surface of the inner and outer hopper sheets adjacent the lower edges thereof. Each sealing strip is of such width that it has a free longitudinal edge which extends below the lower edge of its respective hopper sheet. The amount by which this free edge extends below the lower edge of its respective hopper sheet must be such that when the hopper door is in its closed position, that panel thereof with which the sealing strip is to cooperate causes the free edge of the sealing strip to be bent inwardly. As a result, the longitudinal free edge of the sealing strip conforms to the nominally flat surface of the hopper door panel with which it cooperates, eliminating all gaps which might occur between the hopper door panel and the hopper sheet to which the sealing strip is attached.

As the hopper car is loaded, two things occur. The lower edges of the panels of the first hopper door of an opposed pair slide a fraction of an inch on the lower panel edges of the second hopper door of the pair, as the hopper doors "seat" under the weight of the lading and form the above described metal-to-metal seal between the abutting door panel lower edges. At the same time, the weight of the lading bears against the free edges of the flexible sealing strips. This forces the free edges tightly against the inside surfaces of their respective hopper door panels, thereby forming seals which will preclude the seepage of a fine, granular commodity between the hopper door panels and their adjacent inner and outer hopper sheets. When the hopper doors shift to their open position, they drop vertically away from the free edges of the seals, allowing the seals to bend downwardly as the lading discharges. The amount by which the free edge of each seal extends below the lower edge of its respective hopper sheet must not be so great that the seal is scrubbed by the lading at the instant of door opening.

A seal of the present invention may also be so located as to close a gap between the upper edge portions of the hopper door panels and the adjacent slope sheet, as will be described hereinafter.

DISCLOSURE OF THE INVENTION

According to the invention, in a hopper car of the type having a plurality of chutes, each comprising substantially triangular hopper sheets and a cooperating pair of opposed hopper doors swingable between a closed position and a downwardly depending open position, seals are provided to prevent seepage of a fine, granular commodity between the hopper doors and the adjacent hopper sheets. The seals comprise elongated strips of flexible material mounted along the inside lower edges of the hopper sheets and having free longitudinal edge portions extending downwardly beyond the lower edges of the hopper sheets. The free edges of the flexible strips are so sized and positioned as to be bent inwardly by and to lie in sealing engagement against the hopper doors when the hopper doors are in their closed position.

Various structures may be used to removably affix the seals to the hopper sheets so that the seals may be replaced when required. The seals may also be used to close a gap between a hopper door and an adjacent slope sheet.

BRIEF DESCRIPTION OF THE DRAWINGS

FIG. 5 is a fragmentary cross sectional view illustrating the left hand portion of the chute of FIG. 3 provided with seals of the present invention.

FIG. 6 is a cross sectional view of one of the elongated flexible sealing strips of FIG. 5.

FIG. 7 is a fragmentary cross sectional view, similar to FIG. 5, but illustrating the hopper door in its closed position.

FIG. 13 is a fragmentary cross sectional view similar to FIG. 5 and illustrating another embodiment of seals of the present invention.

FIG. 14 is a fragmentary cross section view similar to FIG. 7, and illustrating the seals of FIG. 13 with the hopper door in closed position.

FIG. 15 is a fragmentary cross sectional view similar to the left hand portion of FIG. 13 and illustrating the use of a weld stud, rather than a bolt to replaceably attach the flexible strip to the hopper sheet.

FIG. 16 is a fragmentary cross sectional view illustrating the upper end of a hopper door panel and the adjacent slope sheet with a seals of the present invention located therebetween.

DETAILED DESCRIPTION OF THE INVENTION

Figure 1:
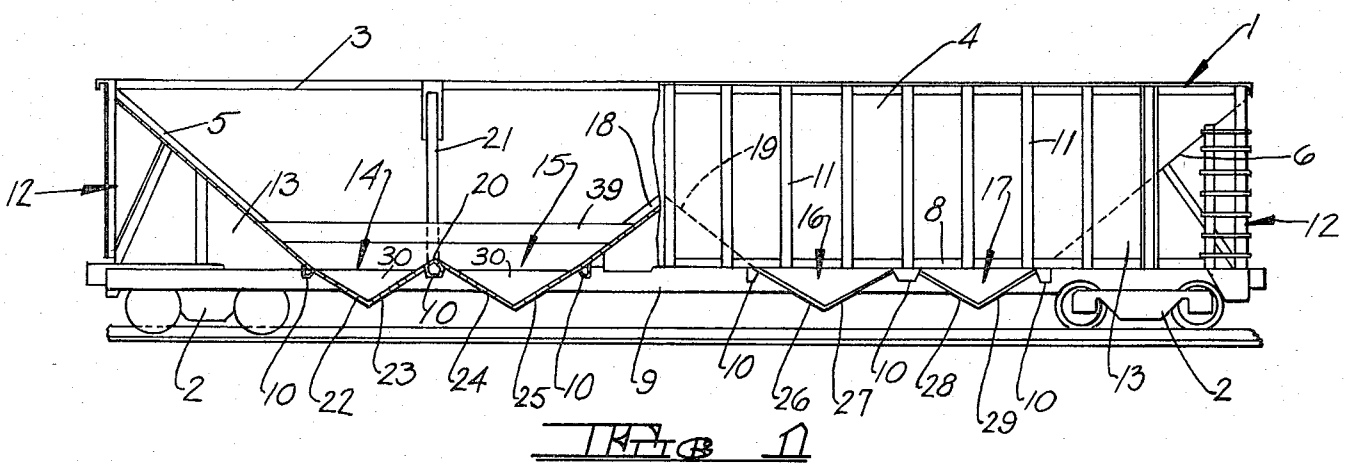
FIG. 1 is a semi-diagrammatic side elevational view, partly in cross section, illustrating a hopper car of the type to which the present invention is directed.
Figure 2:
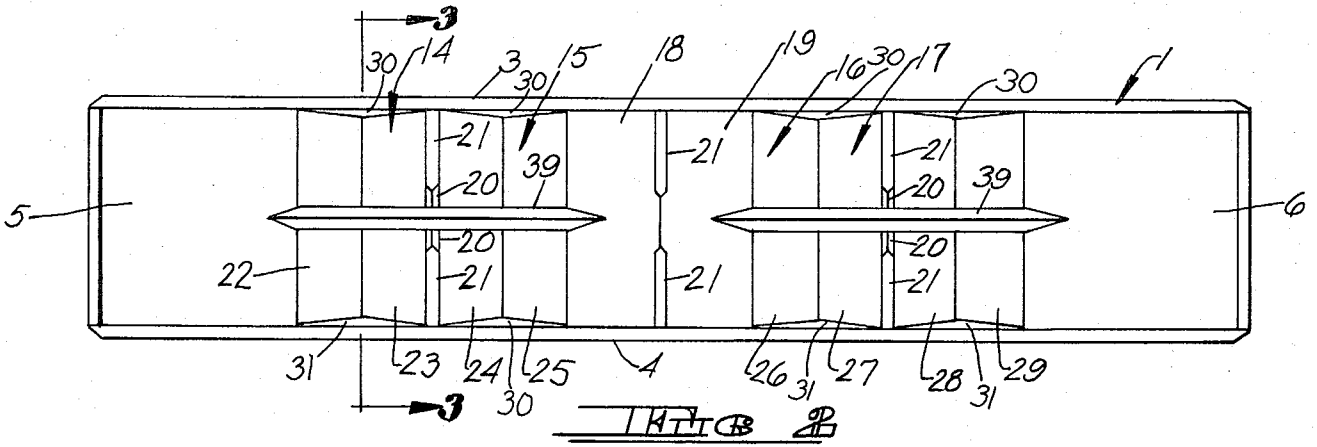
FIG. 2 is a plan view of the hopper car of FIG. 1.
Figure 3:
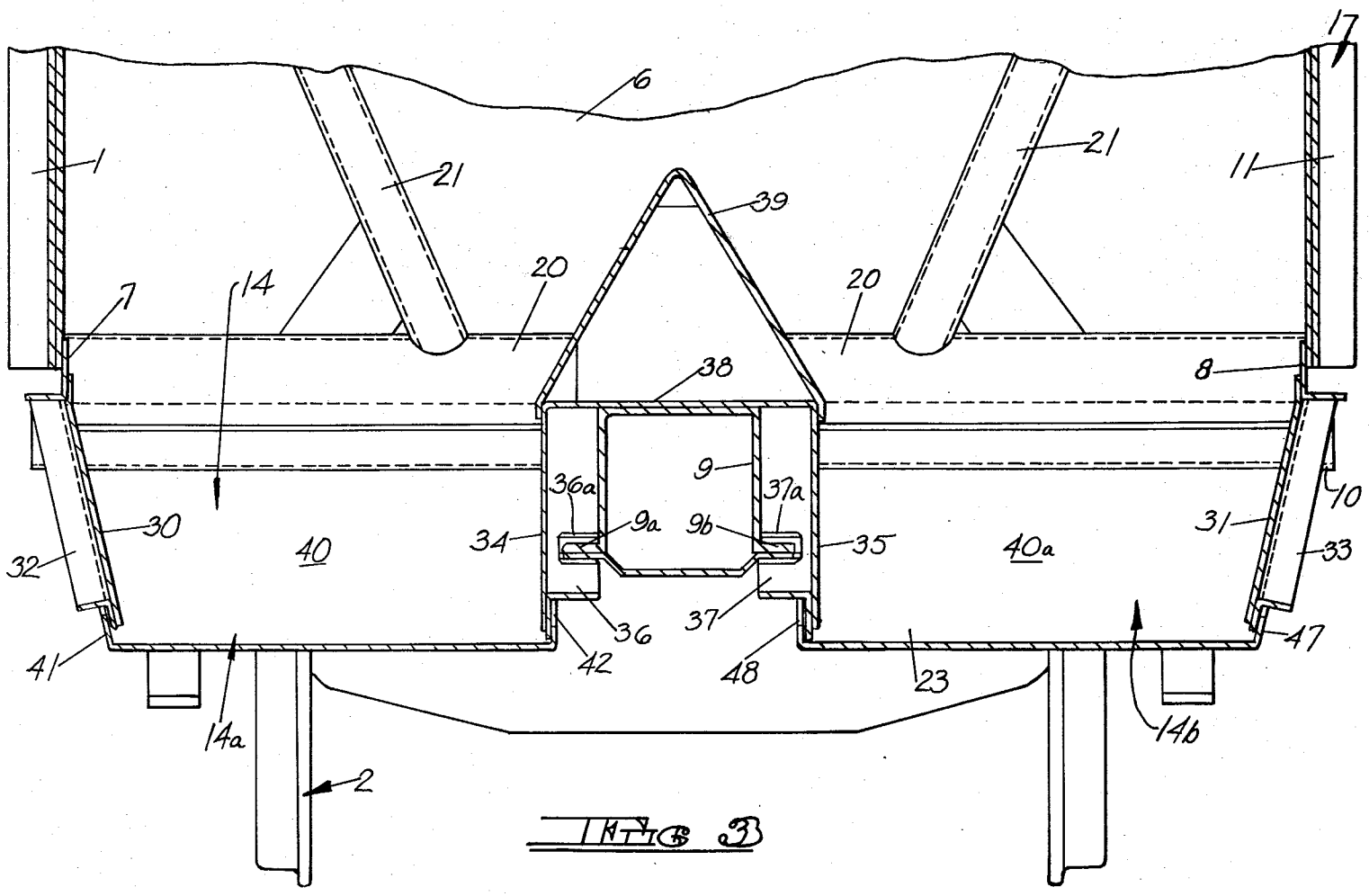
FIG. 3 is a fragmentary cross sectional view taken along section line 3—3 of FIG. 2.

As indicated above, for purposes of an exemplary showing the seals of the present invention will be described in terms of its application to a hopper car of the type taught in U.S. Pat. No. 3,596,609. Such a car is illustrated in FIGS. 1 through 3, wherein like parts have been given like index numerals. The hopper car comprises an elongated body (generally indicated at 1) mounted on conventional trucks 2. The body 1 comprises vertical sides 3 and 4 with inclined end walls or slope sheets 5 and 6.

The car body 1 is provided with a base framework, comprising elongated side frame members or side sills 7 and 8 (see FIG. 3), a longitudinally extending center sill 9 and a plurality of additional frame members 10 extending transversely of the car body from the center sill 9 to the side sills 7 and 8.

It will be understood by one skilled in the art that the ends of the car frame are provided with suitable bracing members (not shown). The sides 3 and 4 have a plurality of vertical braces 11, which extend upwardly from side sills 7 and 8. The ends of the car body also have vertical brace members, generally indicated at 12. The slope sheets 5 and 6 are additionally supported by a plurality of triangular braces 13 extending upwardly from the base frame of the car body to the slope sheets.

As is most clearly shown in FIG. 2, the hopper car is provided with four chutes generally indicated at 14 through 17. The centermost chutes 15 and 16 are separated by small, oppositely slanted slope sheets 18 and 19. The pair of chutes 14 and 15 are separated from each other by transverse brace 10 (see FIG. 1). The pair of chutes 16 and 17 are similarly separated. The transverse braces 10 separating chute 14 from chute 15 and chute 16 from chute 17 may be provided with hoods of inverted V-shaped cross section which not only act as additional transverse supports but also break up the car load and guide it during the discharge operation. These hoods are shown in FIGS. 1 through 3 at 20. Each hood 20 may be considered, for purposes of this description, to be the equivalent of a very small pair of oppositely oriented slope sheets. For additional structural support, the inside of the hopper car 1 may be provided with a plurality of struts 21 extending upwardly and outwardly from the covers 20 and the slope sheets 18 and 19 to the car sides 3 and 4. The struts 21 are preferably tubular in configuration, being of elliptical cross section so as to provide maximum strength and minimum resistance to the discharge flow of the car load.

Each of the chutes are provided with a pair of opposed hopper doors. Thus, in FIGS. 1 and 2 chute 14 is provided with hopper doors 22 and 23; chute 15 is provided with hopper doors 24 and 25; chute 16 is provided with hopper doors 26 and 27; and chute 17 is provided with hopper doors 28 and 29. In recent years, actuating mechanisms have been devised for such hopper doors obviating the necessity for unlatching the doors and closing and latching the doors by hand. An exemplary form of actuating means is taught, for example, in the above mentioned U.S. Pat. No. 3,596,609.

It will be evident form FIGS. 1 through 3 that the center sill 9 of the hopper car partially bisects each of the chutes 14 through 17. Since all of chutes 14 through 17 differ from each other only in relatively minor details, a description of chute 14 may be considered to suffice for chutes 15, 16 and 17, as well. As is most clearly shown in FIG. 3, since the chute 14 is partially bisected by center sill 9, the chute is divided into a left hand portion **14*a* and a right hand portion 14*b* (as viewed in FIG. 3). The chute 14 comprises a pair of substantially triangular outer hopper sheets 30 and 31. The outer hopper sheets 30 and 31 are affixed to and depend downwardly from the hopper car side sills 7 and 8, respectively. It will also be noted that the outer hopper sheets slope downwardly and inwardly of the hopper car sides 3 and 4, respectively. The outer hopper sheets 30 and 31 may be provided with appropriate structural bracing, a portion of which is shown in the form of angle irons 32 and 33 in FIG. 3**.

The chute 14 also comprises a pair of substantially triangular inner hopper sheets 34 and 35, lying to either side of center sill 9. In the particular embodiment illustrated, the center sill 9 is of inverted U-shaped cross section and has laterally extending flanges 9*a* and 9*b*. The inner hopper sheets 34 and 35 may also be provided with appropriate structural bracing, a portion of which is shown in the form of angle irons 36 and 37. It will be noted that angle irons 36 and 37 are appropriately notched as at 36*a* and 37*a* to accommodate the flanges 9*a* and 9*b* of center sill 9. The manner in which the inner hopper sheets 34 and 35 are mounted does not constitute a limitation on the present invention. For purposes of an exemplary showing, the inner hopper sheets 34 and 35 are shown as being part of a one-piece, integral structure, being joined together by the horizontal web portion 38 which is supported by center sill 9. This structure, in turn, supports a cover member 39 of inverted V-shaped cross section. The cover 39 overlies center sill 38 and effectively serves the same purpose therefor as the covers 20 serve for the transverse brace members 10.

The chute 14 comprising outer hopper sheets 30 and 31 and inner hopper sheets 34 and 35, is completed by opposed hopper doors 22 and 23. All of hopper doors 22 through 29 are substantially identical, differing from each other only in minor details which do not constitute a part of the present invention. For purposes of this description, the hopper door 23 illustrated in FIG. 3 is shown in elevation in FIG. 4. Hopper door 23 comprises a pair of panels 40 and 40*a* which are essentially mirror images of each other. The panel 40 has a forwardly extending edge flange 41 adapted to extend about the lowermost edge of outer hopper sheet 30 and brace member 32. The panel 40 has a second forwardly extending edge flange 42 adapted to extend about the lowermost edge of inner hopper sheet 34 and it brace member 36 (see FIGS. 3 and 8). The upper edge 43 of panel 40 is bent slightly rearwardly, as can best be seen in FIGS. 8 and 16. The lowermost edge 44 of panel 40 is straight and substantially coplanar with the main portion of the panel (see FIG. 8).

The panel 40*a* is a mirror image of panel 40. Thus the panel 40*a* has an upper edge 45 which is bent slightly rearwardly and a lower edge 46 which is coplanar with the main portion of the panel. Panel 40*a* has a forwardly extending edge flange 47 adapted to extend about the lowermost edge of outer hopper sheet 31 and its brace member 33 and forwardly extending edge flange 48, adapted to extend about the lowermost edge of inner hopper sheet 35 and its brace member 36 (see FIG. 3).

Figure 4:
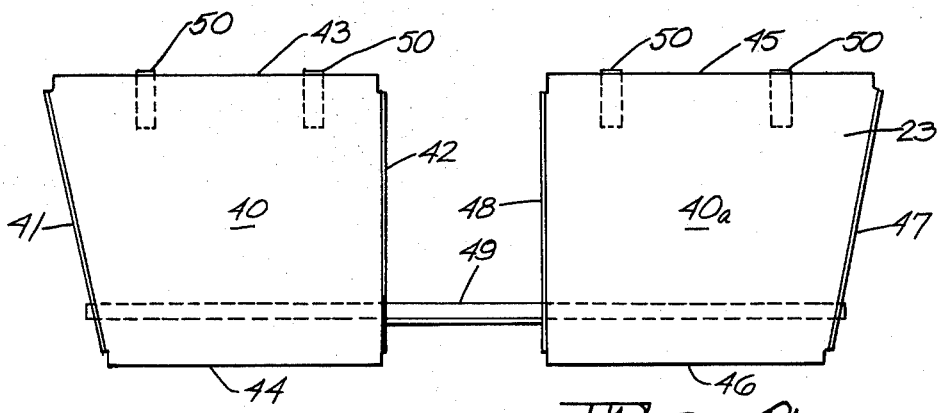
FIG. 4 is an elevational view of an exemplary hopper door.

The panels 40 and 40*a* are provided on their rear side with appropriate reinforcing members (not shown). The panels are joined together by a transverse brace 49 affixed to their rear sides. Finally, the panels 40 and 40*a* are provided each with a pair of hinge elements, all of which may be identical and are shown in FIG. 4 at 50. Each of the hinge elements is provided with a transverse perforation and is adapted to cooperate with a bifurcated hinge element mounted on the adjacent one of transverse brace member 10. One such bifurcated hinge element is shown at 51 in FIG. 16. Its bifurcations are provided with coaxial perforations, one of which is shown at 52. The coaxial perforations of hinge element 51 are adapted to be coaxial with the transverse perforation of hinge element 50 for the receipt of a hinge pin 53, or the like. In this fashion, the door 23 is hingedly supported by transverse frame member 10 so as to be swingable between a closed position and a downwardly depending open position.

It will be understood that the hopper door 22, adapted to cooperate with hopper door 23, is essentially identical thereto. Thus, hopper door 22 is made up of two panels (one of which is shown at 54 in FIG. 8) which are opposed to and cooperate with the panels 40 and 41 of hopper door 23. The panels of hopper door 22 will be provided with forwardly extending flanges adapted to extend about the lowermost edges of outer hopper sheets 30 and 31 and inner hopper sheets 34 and 35 in the same manner described with respect to hopper door 23. Thus, in FIG. 8, the panel 54 of hopper door 22 is shown as having a forwardly extending edge flange 55 extending about the lowermost edge of outer hopper sheet 30 in the same manner as flange 41 of hopper door 23.

As indicated above, various types of seals are known for forming a seal between the lowermost edges of the hopper door panels of an opposed pair. For purposes of a complete disclosure, reference is again made to FIG. 8 wherein the panel 54 of hopper door 23 is shown as being a mirror image of the panel 40 of hopper door 23 with the exception of its lowermost edge which is configured to form a curved return flange 56. As indicated above, the door actuating mechanism which does not constitute a part of the present invention will be so arranged as to cause hopper door 22 to close just ahead of hopper door 23. As the car is loaded, the hopper doors 22 and 23 will "seat" under the weight of the lading. The return flange 56 of hopper door 22 will bear against and conform to the lower edge portion 44 of hopper door 23 forming a continuous metal-to-metal seal along this line of contact.

The present invention is directed primarily to the provision of seals between the hopper door panels and the lower edges of the inner and outer hopper sheets (and the provision of seals along the upper edge of the door panels, as will be described hereinafter). For purposes of exemplary showing, the various embodiments of seals of the present invention will be described in their application to outer hopper sheet 30 and inner hopper sheet 34 for cooperation with panel 40 of hopper door 23. It will be understood that similar seals will be provided along the lowermost edges of outer hopper sheet 31 and inner hopper sheet 35 to cooperate with the panel 41 of hopper door 23. Further, similar seals will be provided on outer hopper sheets 30 and 31 and inner hopper sheets 34 and 35 to cooperate with the panels of hopper door 22 which coact with those of hopper door 23. The seals next to be described can be applied in similar fashion to all of the inner and outer hopper sheets for cooperation with the panels of all of the hopper doors of the railroad car.

Reference is now made to FIGS. 5 through 8 wherein outer hopper sheet 30, inner hopper sheet 34 and hopper door panel 40 of FIG. 3 are shown. In FIGS. 3 and 5 through 8, like parts have all been given like index numerals.

It will be evident from FIG. 3 that no metal-to-metal seal is formed between panel 40 of hopper door 23 and the lowermost edges of outer hopper sheet 30 and inner hopper sheet 34. As indicated above, certain types of fine, granular lading has been found to be sufficiently fluid to seep between the lowermost edges of outer hopper sheet 30 and inner hopper sheet 34 and the hopper door panel 40 and its forwardly extending flanges 41 and 42. To prevent this, the present invention contemplates the provision of elongated resilient seal strips mounted on the inside surfaces of outer hopper sheet 30 and inner hopper sheet 34 near their lowermost edges, the seal strip having longitudinal free edges adapted to contact and form a seal with hopper door pan 40 when the hopper door 23 is in its closed position.

As is clearly shown in FIG. 5, an angle iron member 57 is attached to the inside surface of outer hopper sheet 30 near the lower edge thereof. This is accomplished by welding the free edge of the upper leg portion 57*a* of angle iron member 57 directly to the inside surface of hopper sheet 30. The lower leg 57*b* of angle iron member 57 is spaced from hopper sheet 30 and its reinforcing member 32. As a result, the reinforcing member 32, hopper sheet 30 and angle iron member 57 define a continuous socket 58 which extends longitudinally of the lower edge portion of outer hopper sheet 30. The socket 58 is substantially triangular in cross section and is open along its lowermost portion, as at 59. The angle iron member 57 may be additionally braced by a plurality of triangular members 60 welded to the upper leg 57*a* of the angle iron member 57 and to the inside surface of outer hopper sheet 30.

The inner hopper sheet 34 has affixed thereto an angle iron member 61, essentially identical to angle iron member 57 and provided with triangular braces 62 identical to braces 60. The angle iron member 61 forms an elongated socket 63 extending along the lower edge portion of inner hopper sheet 34 and open along its bottom portion as at 64.

FIG. 6 is a cross sectional view of an elongated, strip-like, resilient seal (generally indicated at 65) for use with the structure of FIG. 5. The seal 65 has an upper head portion 65*a* and a lower lip portion 65*b* which angles downwardly and inwardly with respect to the head portion 65*a*. The head portion 65*a* is hollow, containing the longitudinal cavity 65*c*.

The seal 65 is adapted to have its head portion 65*a* inserted in the socket 58 formed by angle iron 57. The head portion 65*a* of the seal is slightly larger than the socket 58, but the cavity 65*c* in the seal head portion enables the head portion 65*a* to be compressed and distorted. Further distortion of the head portion is caused by the lowermost edge of outer hopper sheet 30. This assures that the head portion 65*a* of seal 65 will be firmly located and held in the socket 58. The lip portion 65*b* of the seal extends through the longitudinal opening 59 formed by angle iron 57 and extends downwardly below the lowermost edge of outer hopper sheet 30 and its brace member 32. A second identical, elongated, resilient seal is mounted in socket 63 formed by angle iron 61. The lip portion of the second seal extends below the lower edge of inner hopper sheet 34 and its brace member 36.

FIG. 7 is substantially identical to FIG. 5, the only difference being that hopper door 23 and hence hopper door panel 40 is illustrated in its closed position (being shown in its open position in FIG. 5). It will be noted that in its closed position, the hopper door panel 40 causes the lip portions 65*b* of the seals to bend inwardly and lie against the hopper door panel. The slight inward bend of the seal lip portions 65*b* assures that this will happen, particularly with respect to that seal mounted on inner hopper sheet 34 which is substantially vertical. This action is assisted with respect to that seal mounted on outer hopper sheet 30 which is, itself, inclined downwardly and inwardly. When the door 23 and its panel 40 shifts to its closed position, causing the lip portions 65*b* of seals 65 to bend inwardly, the lip portions conform to the nominally flat surface of panel 40 eliminating all gaps which might occur between the panel 40 and outer and inner hopper sheets 30 and 34. The lip portions 65*b* of seals 65 must extend below the lower edges of the outer and inner hopper sheets 30 and 34 and their brace members 32 and 36 by an amount sufficient to cause the seals to bend inwardly as shown in FIG. 7. They must also be long enough to eliminate the above mentioned gaps between door panel 40 and the outer and inner hopper sheets 30 and 34. On the other hand, they must not be so long that they will be scrubbed or torn by the load at the instant of opening of the hopper door panel 40.

Figure 8:
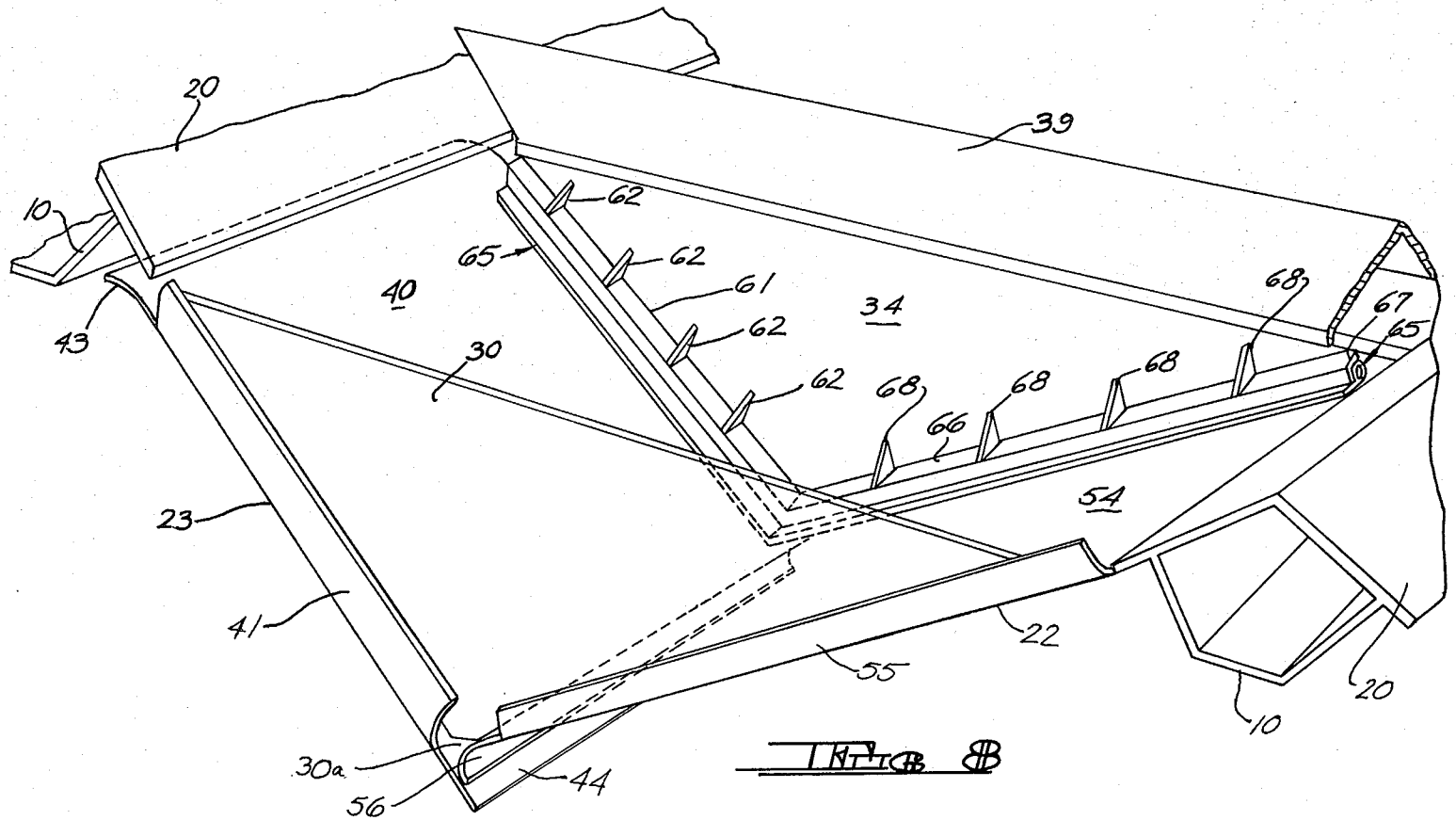
FIG. 8 is a fragmentary perspective view illustating the left hand chute portion of FIG. 3 with both hopper doors in closed position.

Reference is now made to FIG. 8 wherein like parts have been given like index numerals. It will be understood that the hopper door panel 54 of hopper door 22 will also be provided with similar seals. As is shown in FIG. 8, the lower portion of inner hopper sheet 34 is provided with an angle iron 66, identical to angle iron 61 and forming an elongated socket 67. The angle iron 66 is additionally braced by triangular brake members 68, identical to triangular brace members 62. A seals 65 is located in the socket 67 and operates in the very same manner described with respect to seals 65 of FIGS. 5 and 7. It will be understood that that lowermost edge of outer hopper sheet 30 adjacent the panel 54 of hopper door 22 will be provided with an angle iron equivalent to angle iron 57 and a seal 65. These elements will function in the same manner as described with respect to FIGS. 5 and 7.

As the car is loaded, two things occur. The inner door 22 slides on the outer door 23 (FIG. 8) a fraction of an inch causing the hopper doors 22 and 23 to "seat" with respect to each other so that a metal-to-metal seal is formed at the lowermost edges of the panels of these doors, as has been described above. The lading bears against the lip portions 65*b* of the seals 65 forcing these lip portions to seal even tighter against the door panels 40 and 54.

It will be noted that by virtue of the return flange 56 of panel 54 and its contact with the lower edge portion 44 of panel 40, a small substantially triangular gap 30*a* will be formed at the apex of outer hopper sheet 30. A similar opening (not shown) is formed at the apex of inner hopper sheet 34. These openings can be closed by either modifying the apex configuration of hopper sheets 30 and 34 or by small metallic blocks (not shown) of appropriate configuration welded or otherwise affixed to either the apex area of the hopper sheets or to panel 54. The ends of one or both of the seals on both the inner and outer hopper sheets may also be configured to displace into this gap.

When the hopper doors 22 and 23 open, they drop downwardly toward a vertical position and away from the lip portions 65*b* of seals 65. As will be evident from FIG. 5, this permits the lip portions 65*b* of seals 65 to return to their normal configuration, bending downwardly as the lading discharges. The angle irons 57 and 61 will serve as protection for the seals lip portions 65*b* during discharge of the lading by protruding into the path of the lading flow.

The seals 65 may be made of any appropriate, resilient, moldable or extrudable material, which is sufficiently tough and which is compatible with the lading (i.e., which will not be chemically attacked by the lading). Various types of well known plastics and rubbers, for example, can be used. The choice of a material from which to make the seals 65 is well within the skill of the worker in the art. In an exemplary embodiment, excellent results were achieved with a high strength, tear and abrasion resistant rubber capable of maintaining its properties in a temperature range of from about −30° F. to about 140° F. and being chemically resistant to phosphates and ultraviolet light.

Figure 10:
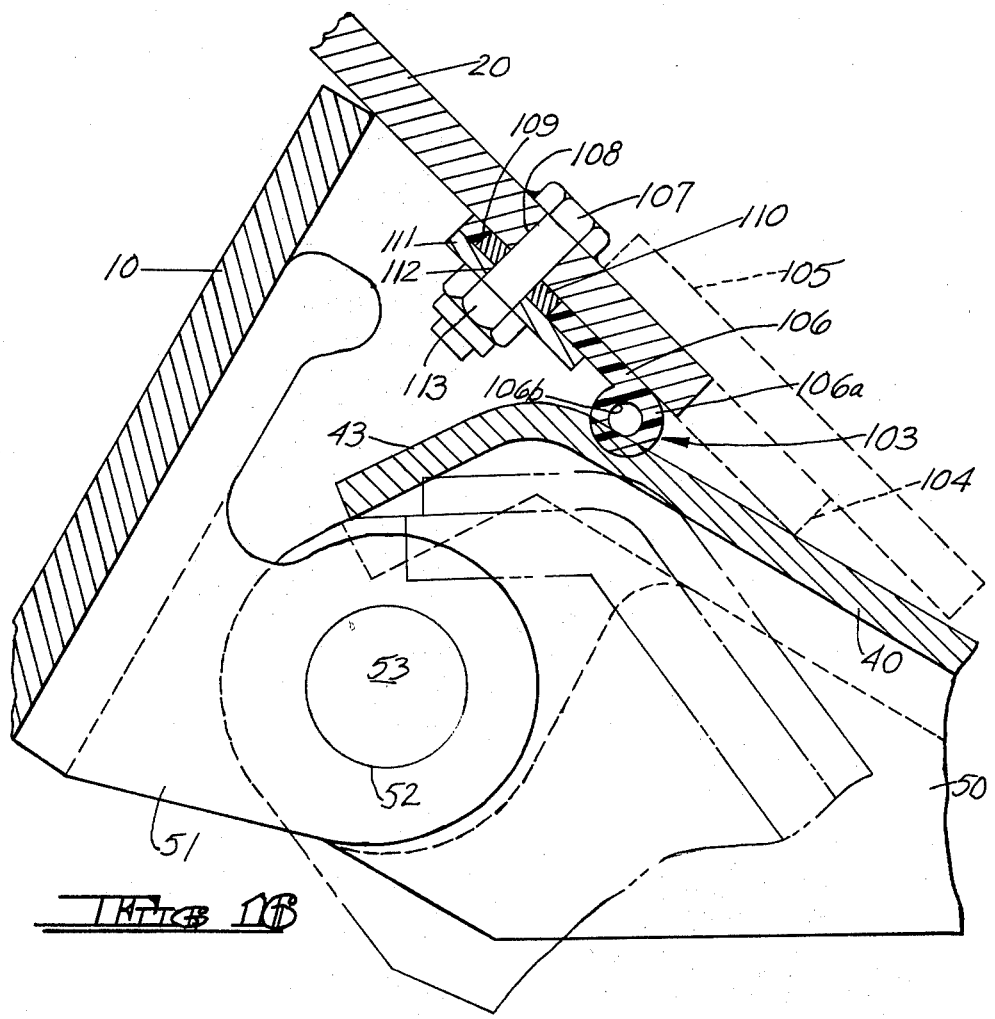
FIG. 10 is a fragmentary cross sectional view, similar to FIG. 7 and illustrating the seals of FIG. 9 with the hopper door in closed position.
Figure 9:
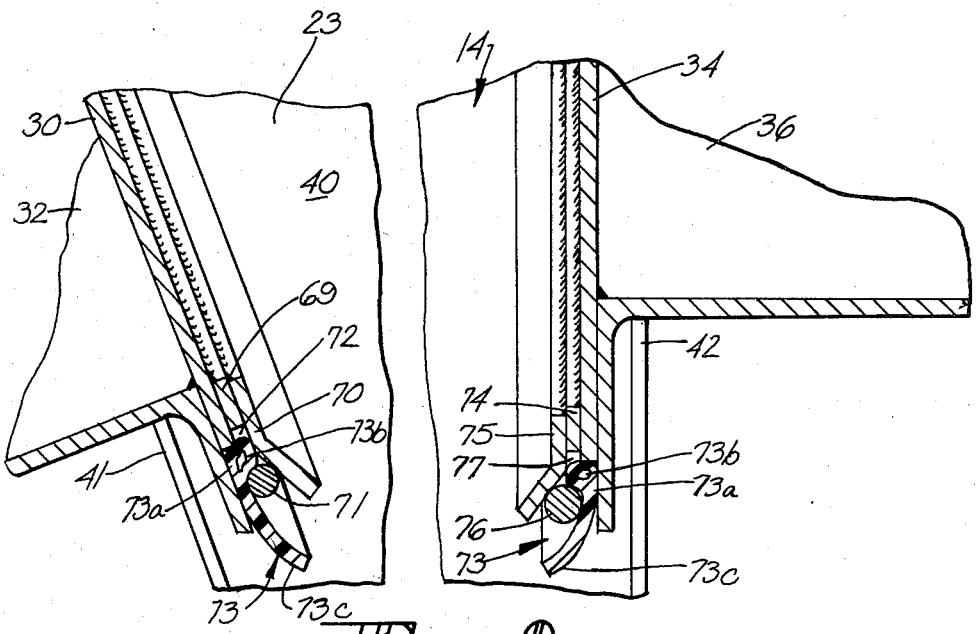
FIG. 9 is a fragmentary cross sectional view similar to FIG. 5 illustrating another embodiment of the seals of the present invention.
Figure 10:
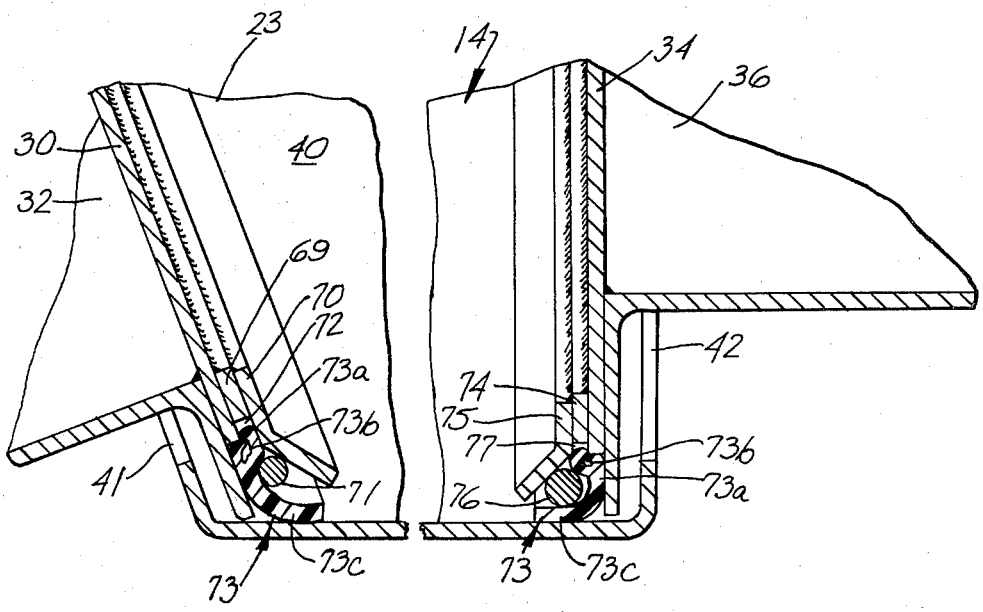

Reference is now made to FIGS. 9 and 10 wherein another embodiment of the present invention is illustrated. FIGS. 9 and 10 are similar to FIGS. 5 and 7 and like parts have been given like index numerals.

Referring first to FIG. 9, the lowermost edges of outer hopper sheet 30 has affixed thereto an intermediate, longitudinally extending metallic strip 69. To this strip 69 there is mounted a second longitudinally extending strip 70 of greater width. On the inside surface of strip 70, near its lower edge, yet another metallic strip 71 is located. The manner of attachment of metallic strips 69 through 71 to each other and to the outer hopper sheet 30 does not constitute a limitation on the present invention. For purposes of an exemplary showing, the attachment is indicated as being accomplished by welding. It will be evident that the strips 69 through 71, in conjunction with the lower portion of outer hopper sheet 30 and its brace member 32 form a longitudinally extending socket 72 of irregular cross section. The socket 72 is equivalent to and is intended to serve the same purpose as the socket 58 of FIGS. 5 and 7. To this end, an elongated, resilient, seal 73 is provided. The seal 73 has a head portion 73*a* with a cavity 73*b* formed therein. This head portion is adapted to be received in the socket 72. Insertion of this seal head portion 73 in socket 72 results in both compression and distortion of the seal head portion 73, permitted by the presence of cavity 73*b*, to assure that the seal 73 will be firmly held in the socket. The seal also has a downwardly and inwardly extending lip portion 73*c* which is adapted to cooperate with hopper door panel 40.

The inner hopper sheet 34 is provided with a similar series of elongated metallic strips. Thus, metallic strips 74, 75 and 76 are equivalent to strips 69, 70 and 71, respectively. The metallic strips 74, 75 and 76 form a cavity 77 adapted to receive the head portion 73*a* of seal 73 with the lip portion 73*c* thereof extending below the lowermost edges of inner hopper sheet 34 and its brace member 36.

FIG. 10 is substantially identical to FIG. 9, and again like parts have been given like index numerals. FIG. 10 differs from FIG. 9 only in that the hopper door panel 40 is shown in its closed position. It will be evident from FIG. 10 that the seals 73 operate in a manner identical to seals 65 described with respect to FIGS. 5, 6 and 7. The seals 73 may be made of any of the materials mentioned with respect to seals 65 of FIG. 6. The metallic strips 69 and 70 on outer hopper sheet 30 and 74 and 75 on inner hopper sheet 74 will protect their respective seals 73 during discharge of the lading from the hopper car.

Figure 11:
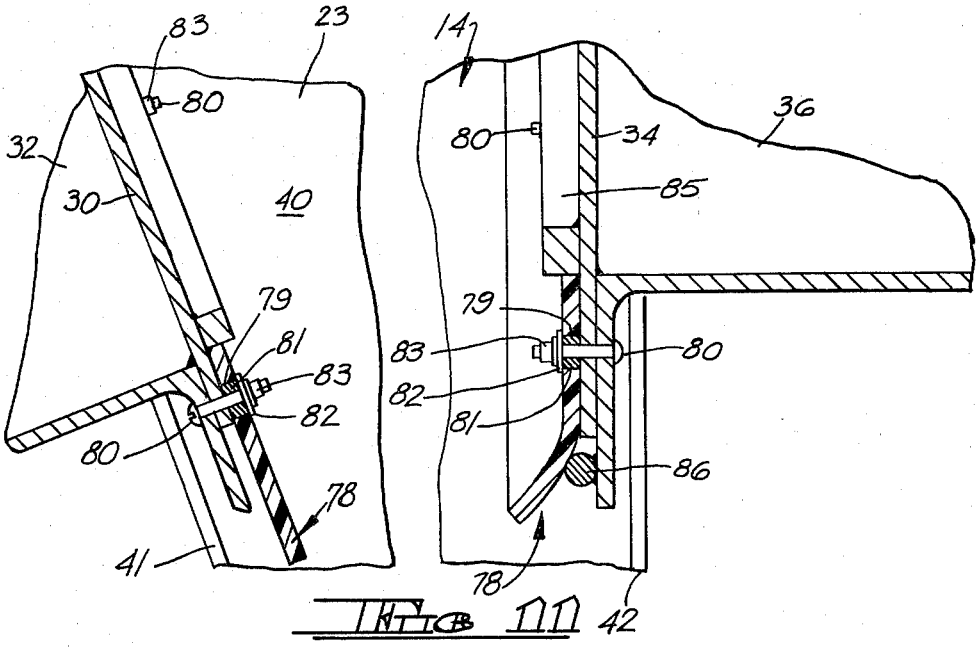
FIG. 11 is a fragmentary cross sectional view similar to FIG. 5 and illustrating yet another embodiment of the seals of the present invention.
Figure 12:
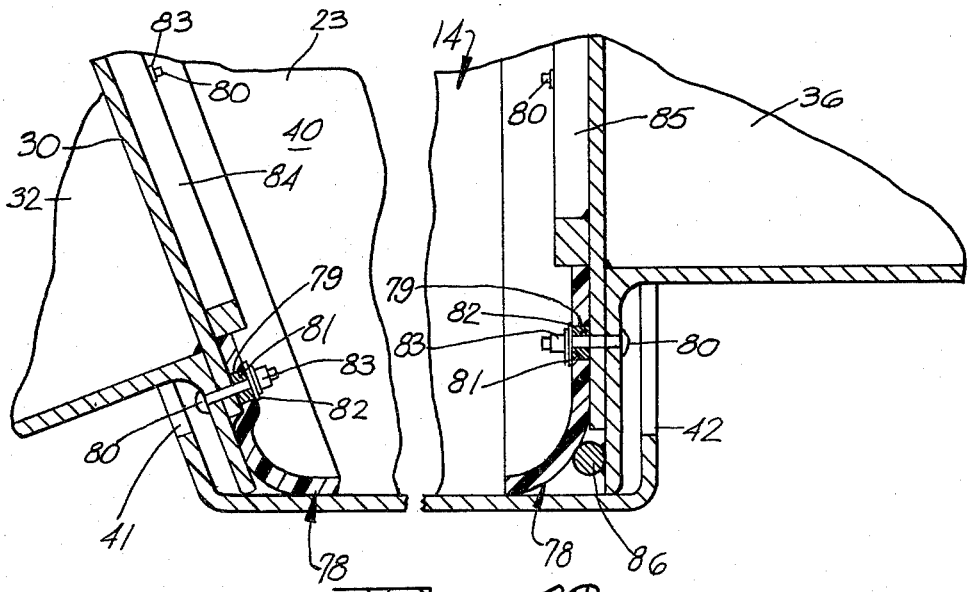
FIG. 12 is a fragmentary cross sectional view similar to FIG. 7 and illustrating the seals of FIG. 11 with the hopper door in closed position.

Another embodiment of the present invention is illustrated in FIGS. 11 and 12. Again FIGS. 11 and 12 are similar to FIGS. 5 and 7 and like parts have been given like index numerals, where applicable. In this embodiment, the seals take the form of simple, flat, elongated strips of resilient material, generally indicated at 78. At appropriate intervals, the seals 78 are provided with perforations 79 for the receipt of bolts 80. On the outer hopper sheet side, the bolts 80 pass through the brace member 32, the outer hopper sheet 30 and the seal 78. Similarly, on the inner hopper sheet side, the bolts 80 pass through the brace member 36, inner hopper sheet 34 and the seals 78. Preferably, the perforations 79 in the seals are so sized as to accept washers 81 having a thickness substantially equivalent to the thickness of the seals and serving as standoffs. The bolts are additionally provided with washers 82 of greater diameter than standoffs 81 and self locking nuts 83. The standoffs 81 enable appropriate tightening of the nuts 83, while preventing the seals 78 from being pinched or worn at their points of attachment to their respective one of outer hopper sheet 30 and inner hopper sheet 34.

Directly above the seal 78 their is affixed (as by welding or the like) directly to the outer hopper sheet an elongated metallic strip 84 having a thickness greater than the thickness of seal 78. The metallic strip 84 serves as a diverter bar, protecting the seal 78 during discharge of the lading from the hopper car. The inner hopper sheet 34 is provided with a similar metallic strip or diverter bar 85, serving the same purpose.

As will be evident from FIG. 11, the seal 78 mounted to the outer hopper sheet 78 slopes downwardly and inwardly at substantially the same angle as the outer hopper sheet and therefor will be bent inwardly and will form a seal with the hopper door panel 40, as shown in FIG. 12. However, since the inner hopper sheet is substantially vertical, a deflector bar 86 is welded or otherwise affixed to the lower edge portion of brace member 36 and extends the length of the adjacent seal 78. The deflector bar 86 may constitute a metallic strip or the like. For purposes of an exemplary showing, it is illustrated as being a rod-like element of circular cross section. The deflector bar 86 has a diameter greater than the thickness of inner hopper sheet 34 so that it deflects the lip portion or lower edge of the adjacent seal 78 inwardly to assure that it will be folded inwardly and form a seal with the hopper door panel 40 when the hopper door is in closed position, as illustrated in FIG. 12.

The seals 78 of FIGS. 11 and 12 can be again made of any appropriate, resilient material such as plastic, rubber or the like. They could also comprise resilient metallic strips. In addition, they could constitute laminates of rubber or plastic with an intermediate strengthening layer of fabric, metal, or other appropriate flexible or resilient material. While the seals 78 are shown as being simple, planar, elongated strips, the downwardly depending lip portions of the strips could have a permanent curl or inward bend imparted to them if desired.

Another embodiment of the present invention is illustrated in FIGS. 13 and 14. FIGS. 13 and 14 are similar to FIGS. 5 and 7, and again like parts have been given like index numerals.

Turning first to FIG. 13, an elongated metallic strip 87 is welded or otherwise affixed to the lower edge of outer hopper sheet 30. The strip 87 extends below the lowermost edges of outer hopper sheet 30 and an additional metallic strip 88 may be located between the strip 87 and the lower edge of brace member 32 for additional strength, if desired. The additional strip 88 may be welded both to strip 87 and the lower edge portion of brace member 32. At appropriate intervals, the strip 87 is provided with a countersunk perforation 89 adapted to receive the head of a bolt 90. The head portion of the bolt 90 may be welded or otherwise permanently affixed to strip 87 so as not only to be captively held by the strip 87, but non-rotatively held as well. Seals 91 (which may be of the type described with respect to FIGS. 11 and 12 at 78) is provided with appropriate perforations 92 at the positions of bolts 90. Preferably, the perforations 92 are so sized as to accommodate washers or standoffs 93 of the type described at 81 in FIGS. 11 and 12. Next, an elongated metallic plate or strip 94 is suitably perforated so as to be mountable on bolts 90. The bolts are thereafter provided with nuts 95. It will be noted form FIG. 13 that, as in the case of FIGS. 11 and 12, the seals 91 slopes downwardly and inwardly at the same angle as the outer hopper sheet 30, thus assuring that it will be bent inwardly by and will form a seal with the hopper door panel 40, as shown in FIG. 14, when the hopper door panel is in its closed position. The lower portion 94 of metallic strip or plate 94 is bent downwardly and inwardly and serves as a deflector for the lading to protect seal 91 during discharge of the lading from the hopper car.

As will be evident from FIG. 13, a similar arrangement of parts is mounted to the inner hopper sheet 34. Thus, a metallic strip 96, equivalent to metallic strip 87, is welded or otherwise permanently affixed to the inner hopper sheet 34. The metallic strip 96 is provided with a plurality of appropriately spaced countersunk perforations 97 to accommodate for bolts 98, equivalent to bolts 90. A seal is provided which is identical to the seal 91 and is given the same index numeral. Again, standoffs 99, equivalent to standoffs 93 are provided. An elongated metallic strip or plate 100, equivalent to plate 94 is mounted on the bolts 98 and is held in place by nuts 101. The elongated metallic strip or plate 100 has an inwardly and downwardly bent portion **100*a* equivalent to the downwardly and inwardly bent portion 94*a* of plate 94. This again serves as a deflector for the lading, protecting seal 91** during discharge of the lading from the hopper car.

The arrangement of parts affixed to inner hopper sheet 34 differs from those affixed to outer hopper sheet 30 primarily in that the lower portion **96*a* of metallic strip 96 is bent slightly inwardly to provide an inward bend to the lower lip portion of seal 91. This is necessary to assure that the seal 91, affixed to inner hopper sheet 34, will be bent inwardly and form a seal with hopper door panel 40 when the hopper door is in its closed position, as shown in FIG. 14. It will be understood that the seals 91 of FIGS. 13 and 14 could be made of any of the materials described with respect to seals 78 of FIGS. 11 and 12**.

FIG. 15 illustrates a modification of the structure of FIG. 13, and again like parts have been given like index numerals. In the embodiment of FIG. 15, the only difference lies in the fact that the bolts 90 of FIGS. 13 and 14 have been replaced by threaded weld studs 102, as are known in the art. The weld studs 102 are welded directly to the metallic strip 87 at appropriate positions, eliminating the bolt 90 and the countersunk perforation 89. It will be understood that the bolts 98 on the inner hopper sheet side of the structure could also be replaced with weld studs in the same manner. Weld studs could also be used in place of the bolts 80 in the embodiment illustrated in FIGS. 11 and 12.

Reference is now again made to FIG. 16 which illustrates the upper edge of hopper door panel 40 and its hinged attachments 50 and 51 and hinge pin 53 to transverse brace member 10. FIG. 16 also illustrates the adjacent edge of hood or small slope sheet 20 (see also FIGS. 1, 2, 3 and 8). In FIG. 16, the hopper door panel 40 is shown in its closed position in full lines and in its downwardly depending open position on broken lines.

As will be evident from FIG. 16, when the door panel 40 is in its closed position a small gap, generally indicated at 103, exists between the door panel 40 and the lowermost edges of slope sheet 20. The geometry is such that the lading would be required to flow uphill against gravity, and through the narrow gap 103 for there to be leakage of a fluid commodity or lading at this point. Normally, for most fluid materials carried in such hopper cars, the gap 103 does not provide a problem.

Should a leakage problem occur at the gap 103, several expedients may be practiced to prevent it. First of all, the hood or slope sheet 20 may be made longer, as is indicated in broken lines 104, so that gap 103 is substantially eliminated. For existing cars, a transversely extending metal plate (shown in broken line 105) may be welded or otherwise affixed to the slope sheet 20 to in effect lengthen it and substantially eliminate gap 103.

Yet another expedient would be to provide a seal of the present invention at the position of gap 103. Such a seal is illustrated at 106 in FIG. 16. The seal comprises an elongated resilient member affixed transversely to the underside of slope sheet 20 along the lowermost edge thereof. The resilient member has formed at its lowermost edge a bulbous portion **106*a* provided with a cavity 106*b*. When the hopper door panel 40 is in its closed position, the bulbous portion 106*a* of seal 106 is of a diameter greater than the width of gap 103 and is capable of being compressed and distorted to fill gap 103 (by virtue of cavity 106*b***).

The seal 106 may be affixed to the underside of slope sheet 20 by any suitable arrangement, including any of the structures described above. For purposes of an exemplary illustration, the seal 106 is illustrated as being mounted on the slope sheet 20 by a plurality of bolts, one of which is shown at 107. The bolt 107 extends through a perforation 108 in slope sheet 20 and it will be understood that a plurality of such bolts extends through a plurality of perforations transversely along the slope sheet. The seal 106 is provided with a plurality of perforations 109 at the positions of bolts 107. Preferably, the seal perforation 109 is of such size as to accommodate a standoff or washer 110 similar to the standoffs 82 of FIGS. 11 and 12 or 93 and 99 of FIGS. 13 through 15. An elongated metallic strip 111 is provided with a plurality of perforations, one of which is shown at 112. The perforations 112 are adapted to receive the bolts 107, which are provided with nuts, one of which is shown at 113.

As indicated above, the precise configuration of the seal 106 and the manner in which it is affixed to the slope sheet 20 may be varied. For example, an angle iron of the type shown at 57 and 61 in FIGS. 5 and 7 may be used to mount an appropriately configured seals to the slope sheet 20. Furthermore, threaded weld studs could be used to replace bolts 107 in FIG. 16.

Modifications may be made in the invention without departing from the spirit of it.

What we claim is:

1. In a hopper car of the type having a plurality of chutes, each comprising substantially triangular hopper sheets and a cooperating pair of opposed hopper doors swingable between a closed position and a downwardly depending open position, each of said substantially triangular hopper sheets being mounted on said hopper car with its apex pointing downwardly and having a pair of converging lower edge portions each located adjacent one of said doors of said pair when said doors are in said closed position, said hopper doors having substantially planar inside surfaces extending between said hopper sheets, seal means to prevent seepage of a fine granular commodity between said hopper doors and the adjacent lower edge portions of said hopper sheets, said seal means comprising elongated strips of flexible resilient material mounted along the inside surface of each of said lower edge portions of said hopper sheets, each of said seal means having a free longitudinal edge portion extending below said lower edge portion of said hopper sheet to which it is attached by an amount sufficient to be bent inwardly by and to lie in substantial sealing engagement against said planar surface of the adjacent one of said hopper doors when said adjacent hopper door is in said closed position with the weight of said commodity bearing against said free longitudinal edge portion forcing it tightly against said hopper door planar surface when said hopper car is loaded to complete said sealing engagement.

2. The structure claimed in claim 1 including means to protect said seal means from said commodity during unloading of said hopper car when said hopper doors are in said open position.

3. The structure claimed in claim 1 wherein said elongated strips of flexible resilient material are removably and replaceably affixed to their respective hopper sheets.

4. The structure claimed in claim 1 wherein each of said seal means comprises a strip of flexible resilient material having an upper longitudinal portion of enlarged cross section and a lower longitudinal lip portion configured to be bent inwardly by and lie in sealing engagement with said planar surface of the adjacent one of said hopper doors when in said closed position, each of said hopper sheets having along said inside surface of each of its lower edge portions means forming an elongated socket having an open slot-like lower portion, each of said sockets being adapted to receive and retain said enlarged upper longitudinal portion of a seal means with the lip portion thereof extending downwardly through said open slot-like bottom portion of said socket.

5. The structure claimed in claim 4 wherein each of said socket forming means is fabricated of elongated metallic strips.

6. The structure claimed in claim 4 wherein each of said socket forming means comprises an angle iron having first and second legs, said first leg having a free edge attached to said inside surface of one of said lower edge portions of one of said hopper sheets, said second leg of said angle iron being spaced from said last mentioned inside surface, said angle iron and said inside surface to which it is attached defining an elongated socket of substantially triangular cross section with said spaced free edge of said second angle iron leg defining said slot-like open portion of said socket, said upper portion of said seal means having a substantially triangular cross section configured to be received and retained in said socket.

7. The structure claimed in claim 1 wherein each of said seal means comprises a substantially planar strip of flexible, resilient material, the inside surface of each of said lower edge portions of each of said hopper sheets being provided with a plurality of laterally extending threaded fastening means arranged in linear spaced relationship, each seal means having a plurality of perforations therein so spaced as to permit passage therethrough of said threaded fastening means along said inside surface of one of said hopper sheet lower edge portions, said seal means being removably fastened to said inside surface of said hopper sheet lower edge portion by washer and nut sets mounted on each of said threaded fastening means extending therethrough.

8. The structure claimed in claim 7 wherein said perforations in said seal means are so sized as to accommodate standoff washers mounted on said threaded fastening means.

9. The structure claimed in claim 7 wherein said threaded fastening means comprise bolts passing through said lower edge portions of said hopper sheets.

10. The structure claimed in claim 7 wherein said threaded fastening means comprise weld studs affixed to said inside surface of said lower edge portions of said hopper sheets.

11. The structure claimed in claim 7 including a first elongated metallic strip affixed to said inside surface of each of said lower edge portions of each of said hopper sheets, said fastening means comprising bolts passing through countersunk perforations in said strip and fixedly held therein, said seal means being mounted on said bolts adjacent said first metallic strip, a second elongated metallic strip having a plurality of perforations matching said bolts of said first metallic strip, said second metallic strip being mounted on said bolts adjacent said seal means, said second metallic strip having an inturned lower longitudinal edge portion serving as a deflector to protect said seal means when said commodity is discharged from said hopper car.

12. The structure claimed in claim 7 including a first elongated metallic strip affixed to said inside surface of each of said lower edge portions of each of said hopper sheets, said fastening means comprising threaded weld studs mounted on said first metallic strip in said linear spaced relationship, said seal means being mounted on said weld studs adjacent said first metallic strip, a second elongated metallic strip having a plurality of perforations matching said weld studs on said first metallic strip, said second metallic strip being mounted on said weld studs adjacent said seal means, said second metallic strip having an inturned lower longitudinal edge portion serving as a deflector to protect said seal means when said commodity is discharged from said hopper car.

13. The structure claimed in claim 1 wherein said hopper car has substantially vertical sides and a center sill partially bisecting each of said chutes, each of said chutes comprising a pair of outer substantially triangular hopper sheets extending downwardly from said car sides each with its apex pointing downwardly and having a pair of converging lower edge portions and a pair of inner substantially triangular hopper sheets located to each side of said center sill each with its apex pointing downwardly and having a pair of converging lower edge portions, said hopper doors each comprising a pair of hopper door panels having substantially planar inner surfaces, said panels of each hopper door being located to each side of said center sill and each panel approaching a lower edge portion of said inner hopper sheet and a corresponding lower edge portion of said outer hopper sheet on its respective side of said center sill when said hopper door is in said closed position, said elongated strips of flexible resilient material being affixed to the inside surface of each of said lower edge portions of each of said inner and outer hopper sheets with their free longitudinal edge portions extending therebelow.

14. The structure claimed in claim 13 wherein each of said hopper door panels has an upper edge, said hopper car having a slope sheet overlying said upper edge of each of said hopper door panels, said upper edge of each of said panels being located near the underside of its respective slope sheet forming a narrow gap therebetween when said hopper door panel is in its closed position, an elongated strip of resilient flexible material replaceably affixed to said underside of said slope sheet, said strip having an edge portion substantially sealing said gap when said hopper door panel is in said closed position.

15. The structure claimed in claim 13 including means to protect said seal means from said commodity during unloading of said hopper car when said hopper doors are in said open position.

16. The structure claimed in claim 13 wherein said elongated strips of flexible resilient material are removably and replaceably affixed to their respective inner and outer hopper sheets.

17. The structure claimed in claim 13 wherein each of said seal means comprises a strip of flexible resilient material having an upper longitudinal portion of enlarged cross section and a lower longitudinal lip portion configured to be bent inwardly by and lie in sealing engagement with said planar surface of the adjacent one of said hopper door panels when in said closed position, each of said inner and outer hopper sheets having along said inside surface of each of its lower edge portions means forming an elongated socket having an open slot-like lower portion, each of said sockets being adapted to receive and retain said enlarged upper longitudinal portion of a seal means with the lip portion thereof extending downwardly through said open slot-like bottom portion of said socket.

18. The structure claimed in claim 17 wherein each of said socket forming means is fabricated of elongated metallic strips.

19. The structure claimed in claim 17 wherein each of said socket forming means comprises an angle iron having first and second legs, said first leg having a free edge attached to said inside surface of one of said lower edge portions of one of said inner end outer hopper sheets, said second leg of said angle iron being spaced from said last mentioned inside surface, said angle iron and said inside surface to which it is attached defining an elongated socket of substantially triangular cross section with said spaced free edge of said second angle iron leg defining said slot-like open portion of said socket, said upper portion of said seal means having a substantially triangular cross section configured to be received and retained in said socket.

20. The structure claimed in claim 13 wherein each of said seal means comprises a substantially planar strip of flexible, resilient material, the inside surface of each of said lower edge portions of each of said inner and outer hopper sheets being provided with a plurality of laterally extending threaded fastening means arranged in linear spaced relationship, each seal means having a plurality of perforations therein so spaced as to permit passage therethrough of said threaded fastening means along said inside surface of one of said inner and outer hopper sheet lower edge portions, said seal means being removably fastened to said inside surface of said hopper sheet lower edge portion by washer and nut sets mounted on each of said threaded fastening means extending therethrough.

21. The structure claimed in claim 20 wherein said perforations in said seal means are so sized as to accommodate standoff washers mounted on said threaded fastening means.

22. The structure claimed in claim 20 wherein said threaded fastening means comprise bolts passing through said lower edge portions of said inner and outer hopper sheets.

23. The structure claimed in claim 20 wherein said threaded fastening means comprise weld studs affixed to said inside surface of said lower edge portions of said inner and outer hopper sheets.

24. The structure claimed in claim 20 including a first elongated metallic strip affixed to said inside surface of each of said lower edge portions of each of said inner and outer hopper sheets, said fastening means comprising bolts passing through countersunk perforations in said strip and non-rotatively held therein, said seal means being mounted on said bolts adjacent said first metallic strip, a second elongated metallic strip having a plurality of perforations matching said bolts of said first metallic strip, said second metallic strip being mounted on said bolts adjacent said seal means, said second metallic strip having an inturned lower longitudinal edge portion serving as a deflector to protect said seal means when said commodity is discharged from said hopper car.

25. The structure claimed in claim 20 including a first elongated metallic strip affixed to said inside surface of each of said lower edge portions of each of said inner and outer hopper sheets, said fastening means comprising threaded weld studs mounted on said first metallic strip in said linear spaced relationship, said seal means being mounted on said weld studs adjacent said first metallic strip, a second elongated metallic strip having a plurality of perforations matching said weld studs on said first metallic strip, said second metallic strip being mounted on said weld studs adjacent said seal means, said second metallic strip having an inturned lower longitudinal edge portion serving as a deflector to protect said seal means when said commodity is discharged from said hopper car.

* * * * *